United States Patent [19]

Suzuki

[11] Patent Number: 4,747,210

[45] Date of Patent: May 31, 1988

[54] SLIDER HOLDER FOR APPLICATION OF DOUBLE SLIDERS TO A SLIDE FASTENER CHAIN

[75] Inventor: Yasutoshi Suzuki, Kurobe, Japan

[73] Assignee: Yoshida Kogyo K. K., Tokyo, Japan

[21] Appl. No.: 72,758

[22] Filed: Jul. 13, 1987

[30] Foreign Application Priority Data

Jul. 15, 1986 [JP] Japan ..... 61-108290[U]

[51] Int. Cl.[4] ..... B23P 19/04

[52] U.S. Cl. ..... 29/768

[58] Field of Search ..... 29/33.2, 408, 409, 766, 29/768, 808

[56] References Cited

U.S. PATENT DOCUMENTS 4,329,778 5/1982 Doori ..... 29/768

4,355,461 10/1982 Doori ..... 29/768

FOREIGN PATENT DOCUMENTS 25148 3/1981 European Pat. Off. ..... 29/768

2158505 11/1985 United Kingdom ..... 29/766

*Primary Examiner*—Timothy V. Eley

*Attorney, Agent, or Firm*—Hill, Van Santen, Steadman & Simpson

[57] ABSTRACT

An apparatus for holding a pair of sliders for application to a slide fastener chain comprises, in combination with a plurality of angularly spaced slider supports intermettently movable successively through a slider receiving position and a slider applying position, an auxiliary slider support mounted on a frame of the apparatus and disposed in lateral alignment with one of the slider supports which has been brought into the slider applying position. The auxiliary slider support is reversible in position relatively to the one slider holder in such a manner that the distance between the one slider support and the auxiliary support varies upon reversal of the auxiliary slider support.

2 Claims, 4 Drawing Sheets

SLIDER HOLDER FOR APPLICATION OF DOUBLE SLIDERS TO A SLIDE FASTENER CHAIN

BACKGROUND OF THE INVENTION

1. Field of the Invention:

This invention relates to an apparatus for holding two sliders for application to a single slide fastener chain.

2. Prior Art:

Slide fasteners of a bidirectionally openable type are known which are equipped with a pair of sliders mounted in opposed relation; that is, either in tail-to-tail (as shown in FIG. 5) or head-to-head (as shown in FIG. 6) confrontation, either of the sliders being manipulated at the option of the user.

There have been proposed numerous devices for holding sliders for application one at a time to slide fastener chains. One such device is disclosed in U.S. Pat. No. 4,355,461, issued Oct. 26, 1982, which device comprises a slider support automatically receiving sliders one at a time from a supply chute and retaining the slider in a slider-applying position, so that sliders are manually threaded over the slide fastener chain.

In the case where a pair of sliders are to be mounted from opposite directions, one would easily arrive at the notion that this could be done by arranging two of the aforesaid device in opposed series relationship. Such an attempt however would involve enlarged and complicated equipment set-up because two confronting sliders are brought closer in one case (FIG. 5) to each other than in the other case (FIG. 6), so that the spacing across which two slider holders are confronted must be changed to suit the case.

SUMMARY OF THE INVENTION

It is therefore the primary object of the present invention to provide an apparatus for holding a pair of sliders for substantially simultaneous application to a slide fastener chain, which apparatus is simple and compact in construction and easy to operate.

Another object of the present invention is to provide a slider holding apparatus having structural features which enable application of double sliders onto a slide fastener chain either in tail-to-tail or head-to-head confronting relation.

According to the present invention, the foregoing and other objects are attained by an apparatus for holding a pair of sliders for application to a slide fastener chain, which apparatus comprises an indexing plate having a plurality of angularly spaced slider supports each for carrying one slider and intermittently rotatable to angularly move the slider supports successively through a slider receiving position and a slider applying position, and an auxiliary slider support mounted on a frame of the apparatus for carrying sliders one at a time. The auxiliary slider holder is disposed in lateral alignment with one of the slider holders which has been brought into the slider applying position. The auxiliary slider support is detachably mounted on the frame and is reversible in position with respect to the one slider support in such a manner that the distance between the one slider support and the auxiliary slider support varies upon reversal of the auxiliary slider support.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 1:
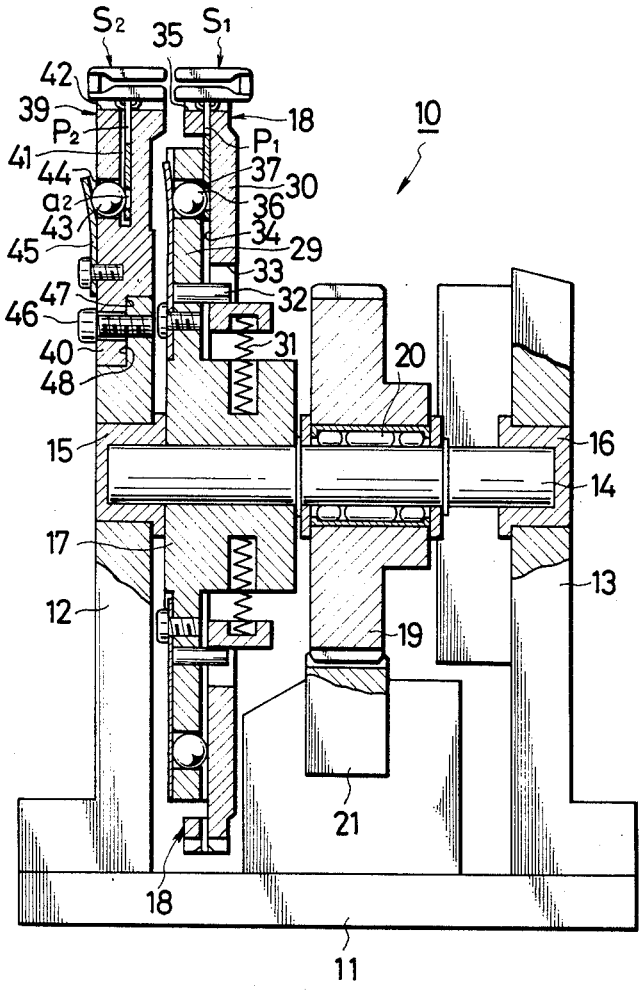
FIG. 1 is a side elevational view, partly in cross section of an apparatus embodying the present invention.

In FIG. 1, there is shown a slider holding apparatus or slider applicator 10 embodying the present invention. The slider holding apparatus 10 includes a frame 11 having a pair of laterally spaced, front and rear upstanding walls 12, 13 between which is supported a horizontal shaft 14 rotatably journalled in a pair of bearings 15, 16 mounted in the walls 12, 13, respectively. The apparatus 10 further includes a substantially square-shaped vertical indexing plate 17 corotatably mounted on the shaft 14 adjacent to the front wall 12. The indexing plate 17 has on its corners a plurality (four in the illustrated embodiment) of slider supports 18 angularly spaced from each other, each for carrying thereon one slider $S_1$ at a time. The indexing plate 17 is angularly moved intermittently through 90 degrees by means of a drive mechanism.

The drive mechanism includes a pinion 19 mounted on the shaft 14, a overrunning or one-way clutch 20 interposed and coupled between the pinion 19 and the shaft 14 to allow the indexing plate 17 to be angularly moved in response to angular movement of the pinion 19 only in one direction (counterclockwise direction in FIG. 3), and a rack 21 slidably supported in the frame 11 in driving mesh with the pinion 19. The rack 21 is reciprocably drivable a predetermined distance in the longitudinal direction by a fluid-pressure actuator such as an air cylinder 22 (FIG. 3) mounted on the frame 11 and operatively connected to the rack 21 via its piston rod 23. With the drive mechanism of the foregoing construction, advancing movement of the rack 21 to the left in FIG. 3 allows only the pinion 19 to rotate freely, with the indexing plate 17 being held non-rotatable. When the rack 21 is returned rightwardly, the indexing plate 17 is angularly moved counterclockwise through 90 degrees to bring the slider supports 18 to four angularly spaced positions. At least one adjacent pair of these positions constitute a first position located adjacent to a slider supply unit 24 and a succeeding second position where a slider $S_1$ held on the slider supports 18 is to be applied to a slide fastener chain F.

Figure 3:
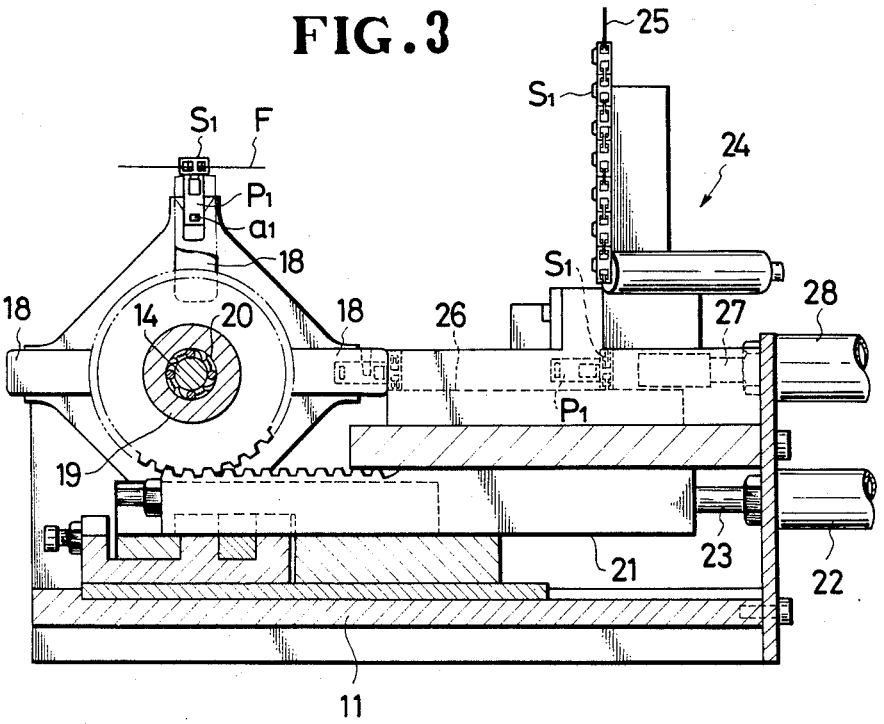
FIG. 3 is a rear elevational view, partly in cross section, of the apparatus shown in FIG. 1.

The slider supply unit 24 shown in FIG. 3 includes a chute 25 along which the sliders $S_1$ are fed by gravity into a horizontal guide groove 26, in which one slider $S_1$ at a time is advanced, with its pull tab $P_1$ directed forwardly, by a pusher rod 27 of a fluid-pressure actuator 28 mounted on the frame 11 toward one of the slider support 18 which is horizontally aligned with the guide groove 26.

Figure 4A:
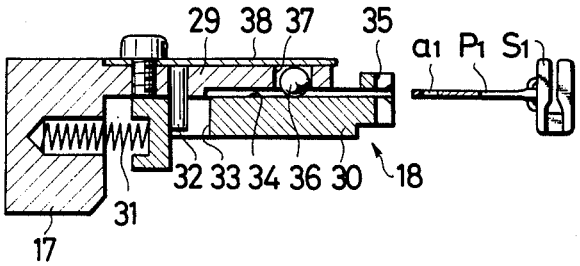
FIGS. 4A, 4B and 4C inclusive are cross-sectional views illustrative of progressive steps of holding a slider on a main slider support.
Figure 4B:
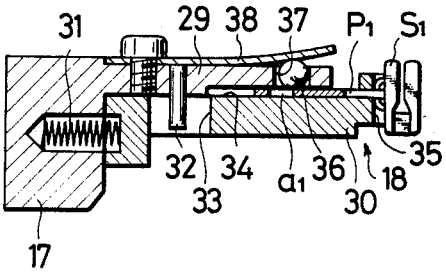
Figure 4C:
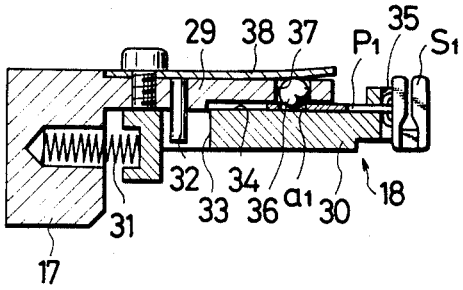

As best shown in FIGS. 4A–4C, each of the slider supports 18 includes an arm 29 projecting radially outwardly from the indexing plate 17, and an elongate slide 30 slidably fitted in the arm 29 for radial movement along the arm 29. The slide 30 is normally urged radially outwardly by a compression spring 31 acting between the slide 30 and the indexing plate 17. To limit radial movement of the slide 30, a stop pin 32 secured to the indexing plate 17 extends horizontally into a slot 33 in the slide 30. Between the arm 29 and the slide 30, there is defined a radial slot 34 which is receptive of the slider pull tab $P_1$ when the slider $S_1$ is seated on a slider rest 35 of the slide 30. A pull tab retainer in the form of a ball 36 is received in part in a hole 37 in the arm 29, which opens into the slot 34. The ball 36 is normally urged toward the slot 34 by a leaf spring 38 held in contact therewith and mounted on the indexing plate 17 by a screw. The ball 36 thus spring-biased partly enters a hole $a_1$ in the slider pull tab $P_1$ when the latter is inserted in the slot 34, and hence acts as a detent for retaining the slider $S_1$ on the slider rest 35.

As shown in FIG. 1, the apparatus further includes an additional or auxiliary slider support 39 mounted on the front wall 12 for mounting, in cooperation with the slider holders 18, a pair of sliders $S_1$, $S_2$ on the fastener chain F simultaneously in a single cycle of operation. To this end, the auxiliary slider support 39 is positioned in lateral alignment with one of the slider supports 18 which has been brought into the second position where a slider $S_1$ mounted thereon is to be applied to the fastener chain F. For facilitating slider application, the slider supports 18 are in uppermost position when in the second position. The auxiliary slider support 39 is composed of a single elongate block 40 but essentially has the same construction as the slider supports 18 in that it includes a guide slot 41 extending longitudinally in the block 40 for receiving the pull tab $P_2$ of a slider $S_2$ when the slider $S_2$ is seated on a slider rest 42 of the block 40. A pull tab retainer comprising a ball 43 is received in part in a hole 44 in the block 40, the hole 44 opening into the slot 41. The ball 43 is normally urged toward the slot 41 by means of a leaf spring 45 held in contact therewith, the leaf spring 45 being secured to the block 40 by a screw. The spring-biased ball 43 enters a hole $a_2$ in the slider pull tab $P_2$ when the latter is inserted in the slot 41, thereby retaining the slider $S_2$ on the slider rest 42.

Figure 2:
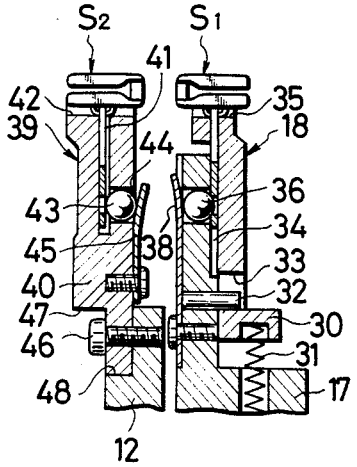
FIG. 2 is a cross-sectional view of a part of the apparatus of FIG. 1, showing an auxiliary slider support reversed in position relative to a main slider support.
Figure 5:
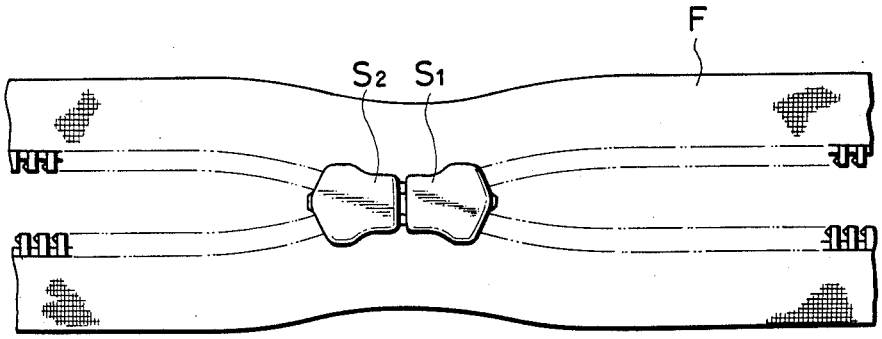
FIG. 5 is a plan view of a length of a slide fastener chain having two sliders mounted thereon in tail-to-tail confronting relation.
Figure 6:
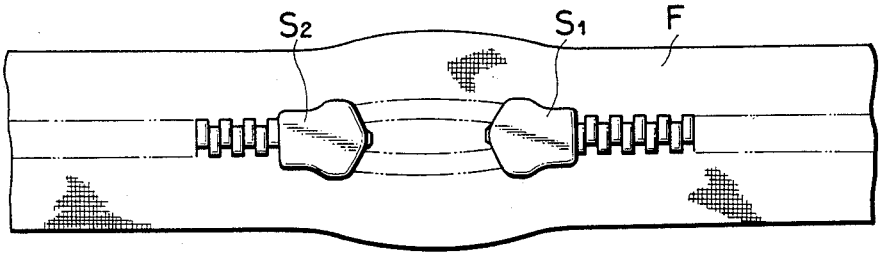
FIG. 6 is a plan view of a length of a slide fastener chain having two sliders mounted thereon in head-to-head confronting relation.

The block 40 and hence the auxiliary slider support 39 is removably connected to the front wall 12 by a screw 46. The block 40 has a stepped lower end portion 47 engageable in complementary with a stepped upper end portion 48 of the front wall 12. When mounting a pair of sliders $S_1$, $S_2$ simultaneously in a tail-to-tail confronting relation as shown in FIG. 5, the auxiliary slider support 39 is mounted on the front wall 12 in the manner as shown in FIG. 1. When it is desired to apply double sliders $S_1$, $S_2$ in a head-to-head confronting relation as shown in FIG. 6, the screw 46 is removed and then the auxiliary slider support 39 is reversed or flipped 180 degrees in position and re-connected by the screw 46 to the front wall 12 as shown in FIG. 2. In this instance, the auxiliary slider support 39 is spaced a greater distance from the holder 18 to meet with the situation of FIG. 6.

The slider holding apparatus 10 of the foregoing construction operates as follows: A slider $S_2$ is manually set on the auxiliary slider support 39 with its tail faced rightwardly in FIG. 1. This setting is achieved by inserting a pull tab $P_2$ of the slider $S_2$ into the slot 41 until the ball 43 partly enters into a hole $a_2$ in the pull tab $P_2$ under the force of the leaf spring 45. Then the operator actuates a switch (not shown) to energize the cylinder 22 whereupon the rack 21 completes a single cycle of reciprocation to thereby turn the indexing plate 17 counterclockwise in FIG. 3 to bring the slider supports 18 to their respective positions. During that time, one slider $S_1$ is advanced through the pusher rod 27 of the fluid-pressure actuator 28. While the indexing plate 17 is held at rest and the rack 21 is being advanced again, the slider $S_1$ is pushed by the pusher rod 27 until the pull tab $P_1$ is inserted into the slot 34 and the slide 30 is forced radially inwardly by the slider $S_1$ (FIGS. 4A and 4B) to get the hole $a_1$ in the pull tab $P_1$ slightly past the ball 36 against the force of the spring 31. Such movement of the slide 30 is stoped when one end of the slot 33 is engaged by the pin 32. Then the pusher rod 27 is moved backwardly to allow the slide 30 to be slightly returned under the force of the spring 31 until the ball 36 partly enters into the hole $a_1$ in the pull tab $P_1$ under the force of the leaf spring 38 (FIG. 4C). At this time, the slider $S_1$ is supported on the slider rest 35 since the pull tab $P_1$ is retained in the slot 34 by the spring-biased ball 36 with a force large enough to hold the slider $S_1$ during advancing movement of the indexing plate 17.

The rack 21 is now moved backwardly to bring the slider support 18 carrying the slider $S_1$ thereon up to the second position in which this slider support 18 is disposed in lateral alignment with the auxiliary slider support 39 carrying the slider $S_2$ thereon, as shown in FIG. 1. Then, a slide fastener chain F with or without a garment such as a fly attached thereto is manually threaded successively through the slider $S_2$ and the slider $S_1$. The slide fastener chain F having double sliders $S_1$, $S_2$ mounted thereon in tail-to-tail confrontation is pulled upwardly until the pull tabs $P_1$, $P_2$ of the respective sliders $S_1$, $S_2$ are released from the spring-biased balls 36, 43 and then removed from the slider supports 18, 39. Thereafter the rack 21 is reciprocated again to angularly advance the indexing plate 17 through 90 degrees to bring the succeeding slider support 18 carrying the next slider $S_1$ thereon into lateral alignment with the auxiliary slider support 39 on which the next slider $S_2$ has been set by the operator.

The foregoing operation meets with the situation shown in FIG. 5 wherein the sliders $S_1$, $S_2$ are mounted in a tail-to-tail confronting relation. Evidently, when it is desired to mount double sliders $S_1$, $S_2$ in a head-to-head confronting relation as shown in FIG. 6, the auxiliary slider support 39 must be reversed in position as shown in FIG. 2.

Obviously, many modifications and variations of the present invention are possible in the right of the above teachings. It is therefore to be understood that within the scope of the appended claims, the invention may be practiced otherwise than as specifically described.

What is claimed is:

1. An apparatus for holding a pair of sliders for application to a slide fastener chain, comprising:

(a) a frame;

(b) a shaft rotatably mounted on and extending between a pair of spaced walls of said frame;

(c) an indexing plate fixedly mounted on said shaft for corotation therewith and having a plurality of angularly spaced slider supports each for carrying one slider thereon;

(d) a drive mechanism operatively connected with said shaft for intermittently rotating said indexing plate to angularly move said slider supports successively through a first position to receive sliders one at a time, and a second position to apply one slider on a slide fastener chain; and (e) an auxiliary slider support detachably connected to one of said walls for carrying one slider and disposed in lateral alignment with one of said slider supports which has been brought into said second position, said auxiliary slider support being reversible in position relatively to said one slider holder in such a manner that the distance between said one slider support and said auxiliary support varies upon reversal of said auxiliary slider support.

2. An apparatus according to claim 1, said auxiliary slider support including a single elongate block detachably connected to said one wall, said block having a stepped portion engageable with a mating stepped portion of said one wall.

* * * * *